US007677575B2

(12) United States Patent
Eisenbarth

(10) Patent No.: US 7,677,575 B2
(45) Date of Patent: Mar. 16, 2010

(54) APPARATUS FOR PLAYING A LAWN GAME

(76) Inventor: Jerome Eisenbarth, 8548 Co. Road 37, Blair, NE (US) 68008

( * ) Notice: Subject to any disclaimer, the term of this patent is extended or adjusted under 35 U.S.C. 154(b) by 402 days.

(21) Appl. No.: 11/724,803

(22) Filed: Mar. 15, 2007

(65) Prior Publication Data

US 2008/0224408 A1 Sep. 18, 2008

(51) Int. Cl.
*A63B 63/00* (2006.01)

(52) U.S. Cl. ..... 273/343

(58) Field of Classification Search ..... 273/343, 273/317, 348; 482/15, 16; 211/202
See application file for complete search history.

(56) References Cited

U.S. PATENT DOCUMENTS

| | | | | |
|---|---|---|---|---|
| 2,445,403 | A * | 7/1948 | Mayerman | 34/622 |
| 4,596,391 | A | 6/1986 | Carolan, Jr. | |
| 6,569,027 | B2 | 5/2003 | Florian | |
| 6,602,146 | B1 | 8/2003 | Pirre | |
| 6,773,014 | B2 * | 8/2004 | Lynch | 273/343 |
| 7,004,468 | B2 * | 2/2006 | Johnson et al. | 273/343 |
| 7,134,661 | B2 * | 11/2006 | Trecartin | 273/343 |
| 2008/0048397 | A1 * | 2/2008 | Mancini | 273/343 |
| 2008/0093803 | A1 * | 4/2008 | Vallee et al. | 273/343 |
| 2008/0224408 | A1 * | 9/2008 | Eisenbarth | 273/343 |

* cited by examiner

*Primary Examiner*—Raleigh W. Chiu
(74) *Attorney, Agent, or Firm*—Raymond M. Galasso; Galasso & Associates LP

(57) ABSTRACT

Golf Gladiator is a lawn game of skill involving balls or other objects connected by a string or rope and a ladder design that has rungs at various distances from the players due to its unique angled design. To play, the ladder assembly is placed a predetermined distance from the players. A player grabs one ball and rope assembly and swings its at the ladder rungs, attempting to get it to wrap around a rung. Each rung has a point value assigned to it. There are three ball and rope assemblies per person or team. Each player or team throws all of his or its ball and rope assemblies and then the next player or team takes his or its turn. A variety of variations on these rules are possible.

8 Claims, 1 Drawing Sheet

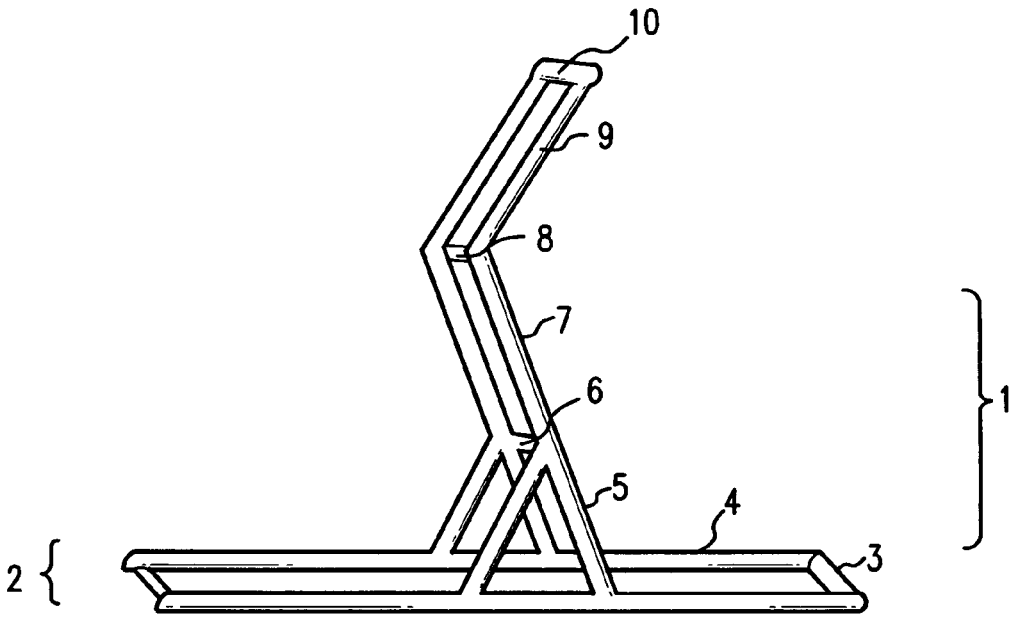
FIG.1
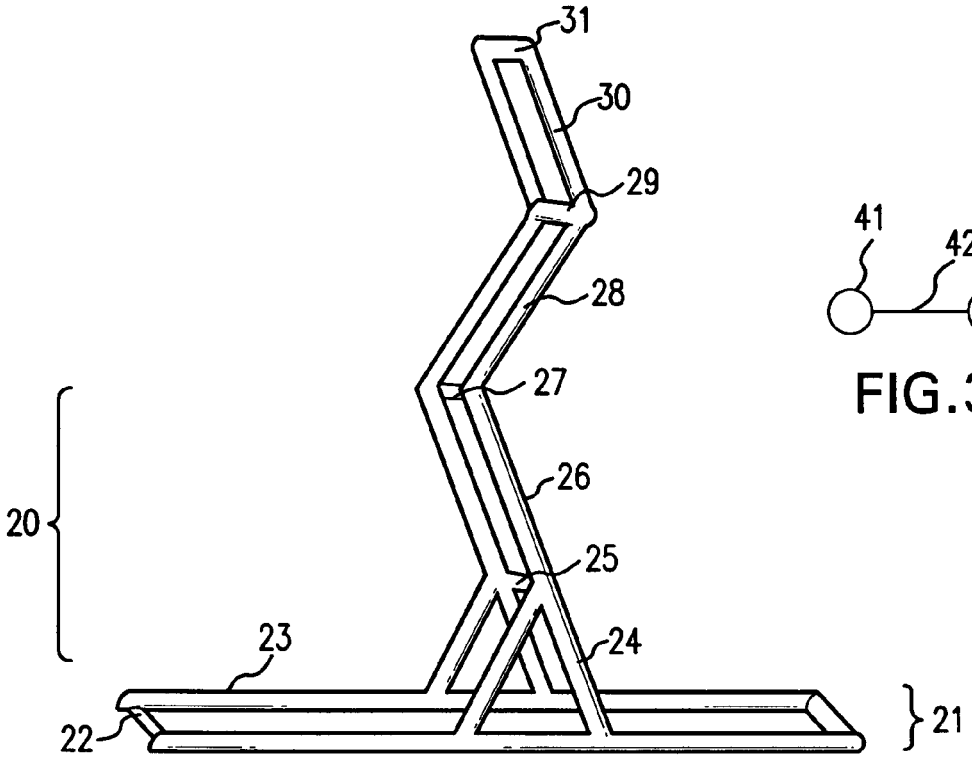
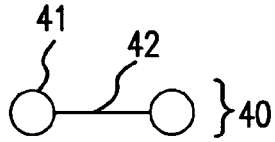
FIG.3
FIG.2

APPARATUS FOR PLAYING A LAWN GAME

CROSS REFERENCE TO RELATED APPLICATIONS

This United States Non-Provisional Patent Application does not claim priority to any United States Provisional Patent applications or any foreign patent applications.

FIELD OF THE DISCLOSURE

The disclosures made herein relate generally to the sporting and game industries. The invention discussed herein is in the general classification of lawn games.

BACKGROUND

Millions of people in the United States enjoy various lawn games at barbeques or other family outings and at parks and beaches. Croquet, horseshoes, tetherball, washers, and badminton are just some of the most common games. Recently, a ladder golf game involving two golf balls tied to opposite ends of a rope and a ladder device has become popular. Players are awarded varying amounts of points by causing the rope to tie around the different ladder rungs when the golf balls are slung at a distance from the ladder device. Multiple players of any age can play this type of game.

Unfortunately, the traditional ladder golf games only utilize a ladder that runs perpendicular to the ground and base, allowing for players to more easily master the game because the rungs are all the same distance from the player.

Hence, there is a need in the art for an inexpensive, durable, easy to use, store, transport, and assemble lawn game of skill involving balls or other objects connected by a string or rope and a ladder design that has rungs at various distances from the players due to its unique angled design.

SUMMARY OF THE DISCLOSURE

Golf Gladiator is a lawn game of skill involving balls or other objects connected by a string or rope and a ladder design that has rungs at various distances from the players due to its unique angled design.

The principal object of this invention is to provide a lawn game that has balls or other objects connected by a string or rope and a ladder design that has rungs at various distances from a player due to its unique angled design.

Another object of this invention is to provide an affordable lawn game.

Another object of this invention is to provide a lawn game that is quickly assembled and easy to play.

Another object of this invention is to provide a safe lawn game.

Another object of this invention is to provide a portable lawn game.

Another object of this invention is to provide a lightweight lawn game.

Yet another object of this invention is to provide a durable lawn game.

BRIEF DESCRIPTION OF THE DRAWINGS

FIG. 1 depicts a side view of the preferred embodiment of the ladder assembly of the present invention.

FIG. 2 depicts a side view of another preferred embodiment of the ladder assembly of the present invention.

FIG. 3 depicts a front view of the preferred embodiment of the golf ball and rope assembly.

DETAILED DESCRIPTION OF THE DRAWINGS

The preferred embodiment of Golf Gladiator is comprised of at least some of the following: an angled ladder assembly with three or four rungs attached to a base and a set of two golf balls attached to rope.

In the preferred embodiment of the invention, shown in FIG. 1, a ladder assembly 1 has a rectangular base 2 having two shorter pipes 3 in the front and the back and two longer pipes 4 on the sides. Upside down V-shaped anchor supports 5 connect to each of the longer pipes 4 of the base 2. A first rung 6 connects the top of the upside down V-shaped supports 5 and attaches to the bottom of support members 7 on each side. The support members 7 are angled at approximately thirty degrees from the perpendicular running to the base 2 through the top of the V-shaped anchor supports 5. A second rung 8 connects the top of the two support members 7. A second set of support members 9 connect to the second rung 8 on the bottom and a third rung 10 at the top. The second set of support members 9 are angled at thirty degrees opposite the angle of the support members 7 such that the third rung 10 is located directly above the first rung 6.

The shorter pipes 3, longer pipes 4, anchor supports 5, support members 7, second set of support members 9, first rung 6, second rung 8 and third rung 10 are ideally made of three-quarter of an inch diameter PVC pipe to minimize costs and increase durability. However, three-quarter of an inch galvanized pipe, aluminum, copper or stainless steel could also be utilized. The diameter of the components could also be altered. Ideally, the ladder assembly 1 would be three feet high, three feet long at the base and two feet wide with the first rung 6 located one foot off of the ground, the second rung 8 located two feet off the ground and the third rung 10 located three feet off the ground.

FIG. 2 shows another version of the preferred embodiment of the ladder assembly of the present invention. A ladder assembly 20 has a rectangular base 21 having two shorter pipes 22 in the front and the back and two longer pipes 23 on the sides. Upside down V-shaped anchor supports 24 connect to each of the longer pipes 23 of the base 21. A first rung 25 connects the top of the upside down V-shaped supports 24 and attaches to the bottom of support members 26 on each side. The support members 26 are angled at approximately thirty degrees from the perpendicular running to the base 21 through the top of the anchor supports 24. A second rung 27 connects the top of the two support members 26. A second set of support members 28 connect to the second rung 27 on the bottom and a third rung 29 at the top. The second set of support members 28 are angled at thirty degrees opposite the angle of the support members 26 such that the third rung 29 is located directly above the first rung 25. A third set of support members 30 connect to the third rung 29 on the bottom and a fourth rung 31 at the top. The third set of support members 30 are angled at thirty degrees opposite the angle of the second set of support members 28 such that the fourth rung 31 is located directly above the second rung 27.

As with the preferred embodiment of FIG. 1, the components of FIG. 2 are ideally made of three-quarter of an inch PVC pipe to minimize costs. However, three-quarter of an inch galvanized pipe, aluminum, copper or stainless steel could also be utilized and the diameter of the components could also be altered. Ideally, the ladder assembly 20 would be four feet high, four feet long at the base and two feet wide with the first rung 25 located one foot off of the ground, the second rung 27 located two feet off the ground, the third rung 29 located three feet off the ground, and the fourth rung 31 located four feet off the ground.

FIG. 3 shows a front view of the preferred embodiment of the golf ball and rope assembly 40 of the present invention. Two golf balls 41 are connected by nylon rope 42. The nylon rope 42 is one quarter of an inch in diameter and one foot in length in the preferred embodiment though a variety of types of rope, string or cord of varying dimensions could be utilized.

To use the preferred embodiment of Golf Gladiator, a player grabs one golf ball and swings the golf ball and rope assembly at the ladder rungs, attempting to get them to wrap around a rung.

The ladder assembly is placed forty feet from the players. There are three golf ball and rope assemblies per team. In the three rung model, the third rung is worth one point, the second rung is worth three points and the first rung is worth two points. In the four rung model, the first rung is worth two points, the second rung is worth three points, the third rung is worth four points and the fourth rung is worth one point. Each player or team throws all of his or its two-ball assemblies and then the next player or team takes his or its turn.

The object of the game is to score twenty-one points first. The winner of each match is determined on the basis of two out of three games. Players must accumulate exactly twenty-one points. Failure to get exactly twenty-one points will result in reduction of points from the points already scored. For example: If the player or team has eighteen points and receives four points on his or their next throw, four points would be deducted from his or their total, resulting in a total of fourteen points.

Obviously, a variety of other ways to play and score the game are possible utilizing the same equipment.

The components of Golf Gladiator may vary but will likely use metal and plastic materials. The metals would ideally be selected from available steel or alloys of steel and aluminum. The production process related to the use of these metals insures that the metal is non-corrosive, durable and strong. The selected metal should have high impact strength and be capable of accepting and retaining coloring materials for an extended length of time.

The plastic used in the production will ideally be selected for durability and longevity. Thermoplastics are commonly used in the manufacturing of components similar to those used in this invention. Polyethylene, polypropylene, and other similar thermoplastic materials would be among those with the necessary traits. Members of this family are recognized universally as being versatile and of high quality.

The plastic components of Golf Gladiator can also be formed with the use of plastic molding techniques, such as injection molding or blow molding. Injection molding requires melted plastic to be forcefully injected into relatively cool molds. As the plastic begins to harden, it takes on the shape of the mold cavity. This technique is ideal for the mass production of products. Alternatively, blow molding, a form of extrusion, could be utilized. Blow molding involves a molten tube being pushed into a mold. Compressed air then forces the molten tube against the cold walls of the mold.

It should be obvious that the components of the present invention can be of various shapes and sizes. It should also be obvious that the components of the invention can be made of different types of metals, plastics or other suitable materials and can be of any color. It should also be obvious that while golf balls and rope are used in the preferred embodiment, a variety of objects connected by string or other similar device could be utilized. Hence, balls or golf balls include any weighted object and rope includes any string or similar object for purposes of this invention. In addition, while a base with an anchor support is the preferred method for stabilizing the ladder assembly and elevating the rungs, a variety of other methods may work and do not require a base. For example, a support could be attached to the bottom of the first rung and then driven into the ground.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A sporting device comprising:

a support that attaches on top to a first rung;

a first support member connected at an angle to the first rung on one end and to a second rung on the other end; and a second support member connected at an angle to the second rung on one end and a third rung on the other end;

wherein said support connects to a base on bottom; and wherein said base is rectangular and has a first shorter pipe in the front and a second shorter pipe in the back and a first longer pipe on one side and second longer pipe on the other side.

2. The device of claim 1 wherein the support is a first upside down V-shaped piping that connects to the first longer pipe and a second upside down V-shaped piping that connects to the second longer pipe.

3. The device of claim 2 wherein the first rung connects the top of the first upside down V-shaped piping and the second upside down V-shaped piping.

4. A sporting device comprising:

a support that attaches on top to a first rung;

a first support member connected at an angle to the first rung on one end and to a second rung on the other end;

a second support member connected at an angle to the second rung on one end and a third rung on the other end; and a rope attached to a first ball on one end and a second ball on the opposite end.

5. The device of claim 4 wherein the rope is nylon.

6. The device of claim 4 wherein the rope is one quarter of an inch in diameter.

7. A sporting device comprising:

a base that is rectangular and has a first shorter pipe in the front and a second shorter pipe in the back and a first longer pipe on one side and a second longer pipe on the other side;

an anchor support made of a first upside down V-shaped piping that connects to the first longer pipe and a second upside down V-shaped piping that connects to the second longer pipe;

a first rung that connects the top of the first upside down V-shaped piping and the second upside down V-shaped piping;

a first support member and a second support member running parallel that are connected at the bottom at an angle to the first rung;

a second rung connecting the top of the first support member and the second support member;

a third support member and a fourth support member running parallel that are connected at the bottom at an angle to the second rung and at the top to a third rung;

the first shorter pipe, the second shorter pipe, the first longer pipe, the second longer pipe, the first upside down V-shaped piping, the second upside down V-shaped piping, the first rung, the first support member, the second support member, the second rung, the third support member, the fourth support member and the third rung are made of PVC pipe; and a rope that is made of nylon attached to a first ball on one end and a second ball on the other end.

8. The device of claim 7 further comprising a fifth support member and a sixth support member running parallel that are connected at the bottom at an angle to the third rung and at the top to a fourth rung.

* * * * *